US007040950B1

(12) United States Patent
Chen

(10) Patent No.: US 7,040,950 B1
(45) Date of Patent: May 9, 2006

(54) THERMAL ENERGY-ACTUATED TOY WATER GLOBE

(76) Inventor: Ching-Chao Chen, No. 511, Sec. 3, Dong Ta Rd., Hsinchu City (TW)

( * ) Notice: Subject to any disclaimer, the term of this patent is extended or adjusted under 35 U.S.C. 154(b) by 171 days.

(21) Appl. No.: 10/867,821

(22) Filed: Jun. 16, 2004

(51) Int. Cl.
*A63H 23/08* (2006.01)

(52) U.S. Cl. ..... 446/267; 446/485; 40/406; 362/101

(58) Field of Classification Search ..... 446/267, 446/484, 485, 14; 40/406, 409, 410, 441; 362/101, 318, 96
See application file for complete search history.

(56) References Cited

U.S. PATENT DOCUMENTS

| | | | | |
|---|---|---|---|---|
| 2,453,177 | A * | 11/1948 | Abramson | 40/406 |
| 4,070,777 | A * | 1/1978 | Lo Giudice | 40/406 |
| 4,170,035 | A * | 10/1979 | Walker | 362/96 |
| 5,599,092 | A * | 2/1997 | Yen | 362/96 |
| 6,449,887 | B1 * | 9/2002 | Song | 40/406 |
| 6,604,835 | B1 * | 8/2003 | Zale | 362/96 |

* cited by examiner

*Primary Examiner*—Kien Nguyen
(74) *Attorney, Agent, or Firm*—Troxell Law Office, PLLC

(57) ABSTRACT

A thermal energy-actuated toy water glove is disclosed to include a transparent plastic globe body holding an organic solvent and glitters in the organic solvent, and a lamp holder supporting the globe body and holding a lamp bulb for heating the organic solvent to the boiling status to cause the glitters to move in the boiling organic solve when turned on to emit light.

8 Claims, 4 Drawing Sheets

THERMAL ENERGY-ACTUATED TOY WATER GLOBE

BACKGROUND AND SUMMARY OF THE INVENTION

The present invention relates to a toy water globe and more particularly a thermal energy-actuated toy water globe, which uses the thermal energy of a lamp bulb to heat a low boiling point fluid in a transparent globe body to the boiling point, thereby moving glitters in the boiling fluid.

A conventional water globe, as shown in FIG. 1, is generally comprised of a spherical body 4 and a base 5. The spherical body 4 holds a certain amount of oil water 41 and glitters 42 in oil water 41. When the user shaken the water globe and then put the water globe on a flat surface, the glitters 42 fall to the bottom side in stirred oil water 41, imitating a fall of snow. However, if the water glove stands still, it does not produce a motional visual effect.

The present invention has been accomplished under the circumstances in view. It is therefore the main object of the present invention to provide a water globe, which produces a motional visual effect without shaking. It is another object of the present invention to provide a water globe, which is safe in use. According to one aspect of the present invention, the thermal energy-actuated toy water globe uses heat energy from a lamp bulb to heat a low boiling point fluid in a transparent globe body, causing glitters to move in the boiling fluid to produce a motion visual effect. According to another aspect of the present invention, the globe body and the bottom cover thereof are respectively injection-molded from plastics for safety use. According to still another aspect of the present invention, a perforated partition member is mounted inside the bottom cover of the globe body to hold down a foam pad inside the bottom cover to accelerate the speed of heating the low melting point fluid to the boiling status and to smoothen the production of air bubbles in the boiling fluid.

DETAILED DESCRIPTION OF THE INVENTION

Figure 1:
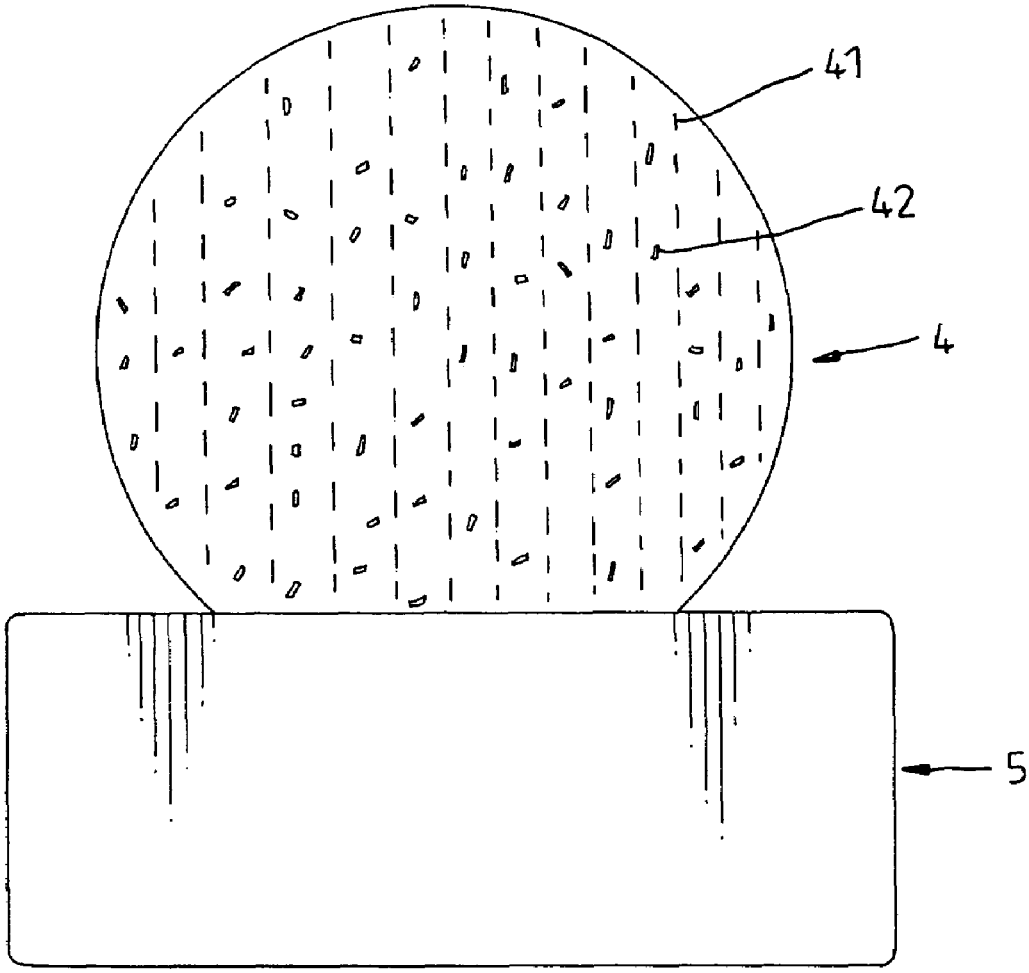
Fig. 1 PRIOR ART
FIG. 1 is a schematic plain view of a water globe a according to the prior art.
Figure 2:
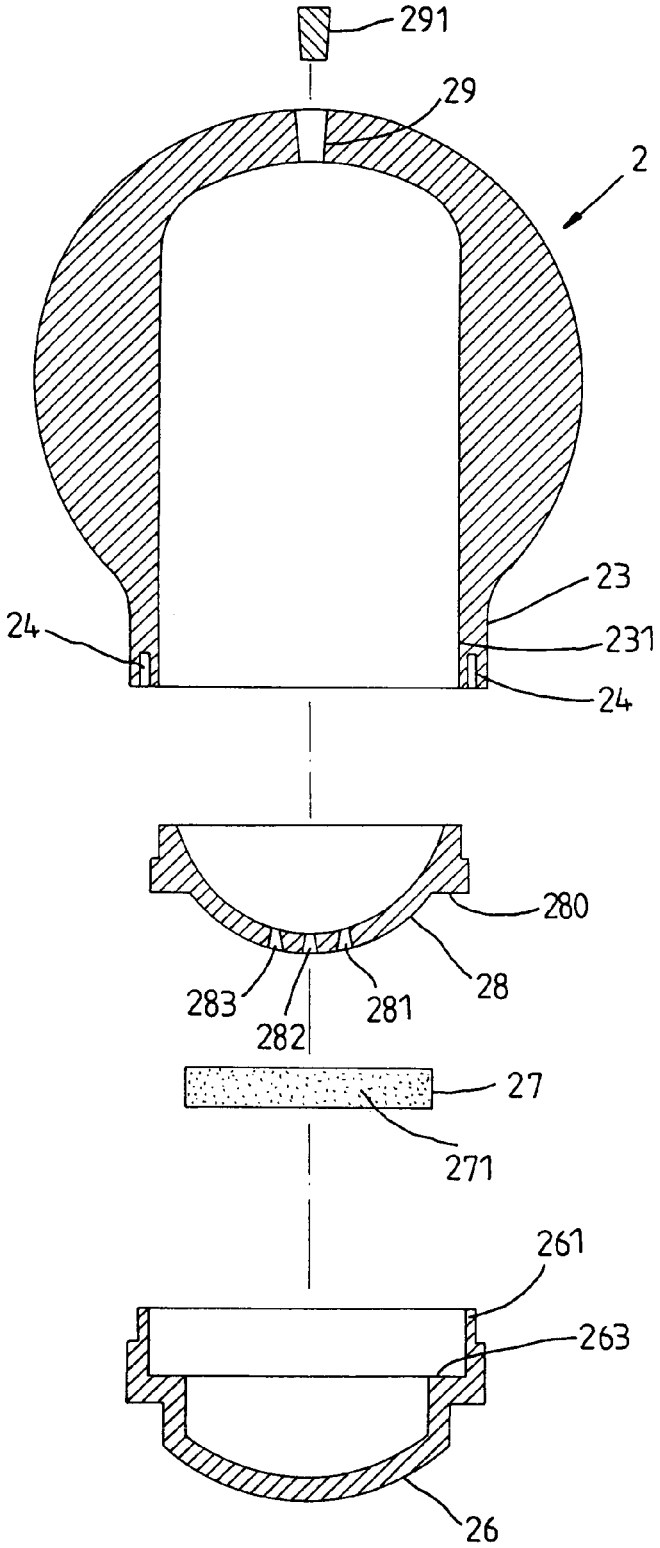
FIG. 2 is an exploded view in section of a water globe according to the present invention.
Figure 3:
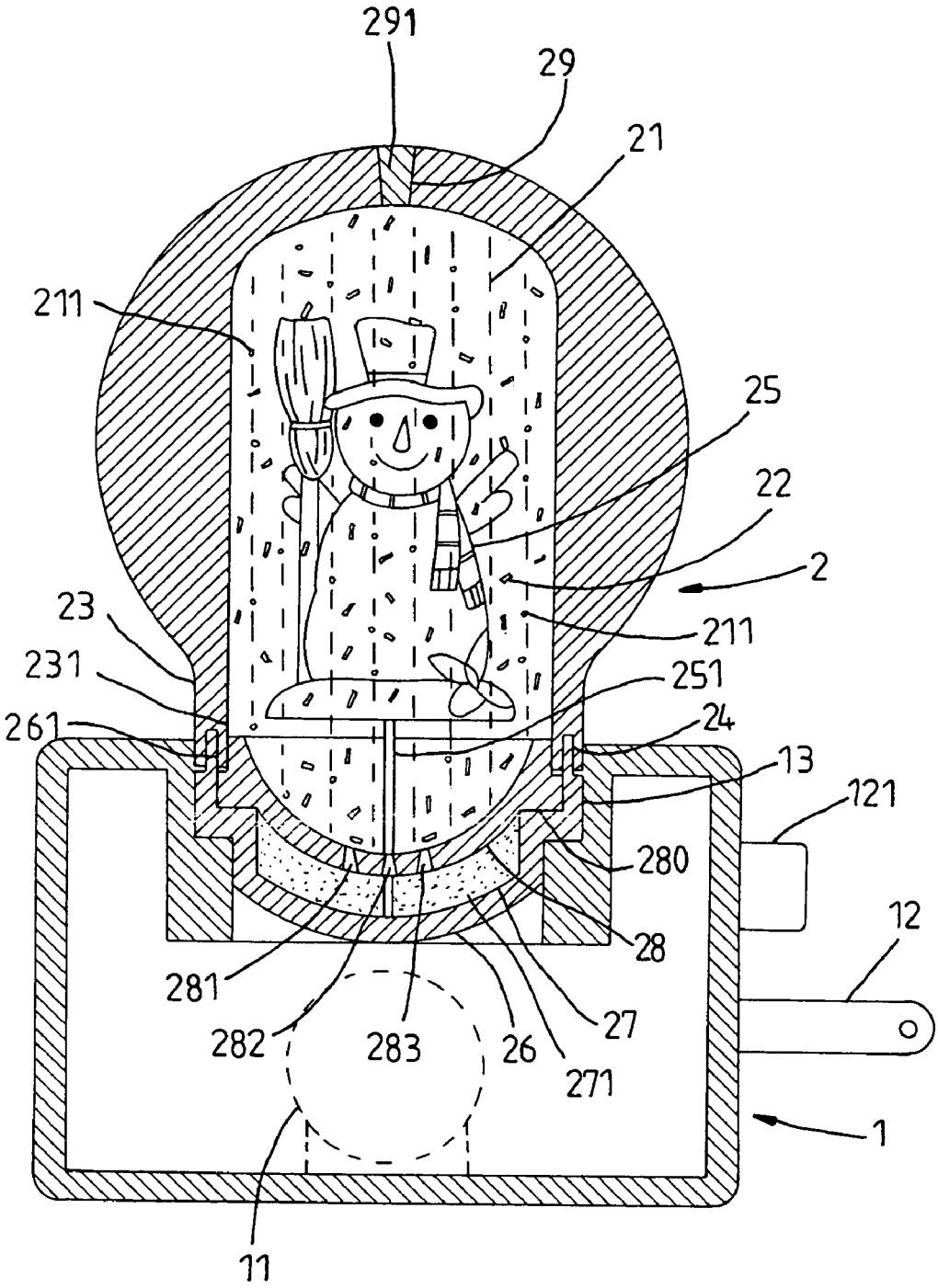
FIG. 3 is a schematic drawing of the present invention, showing the fluid boiled, glitters moved in the boiling fluid inside the globe body.
Figure 4:
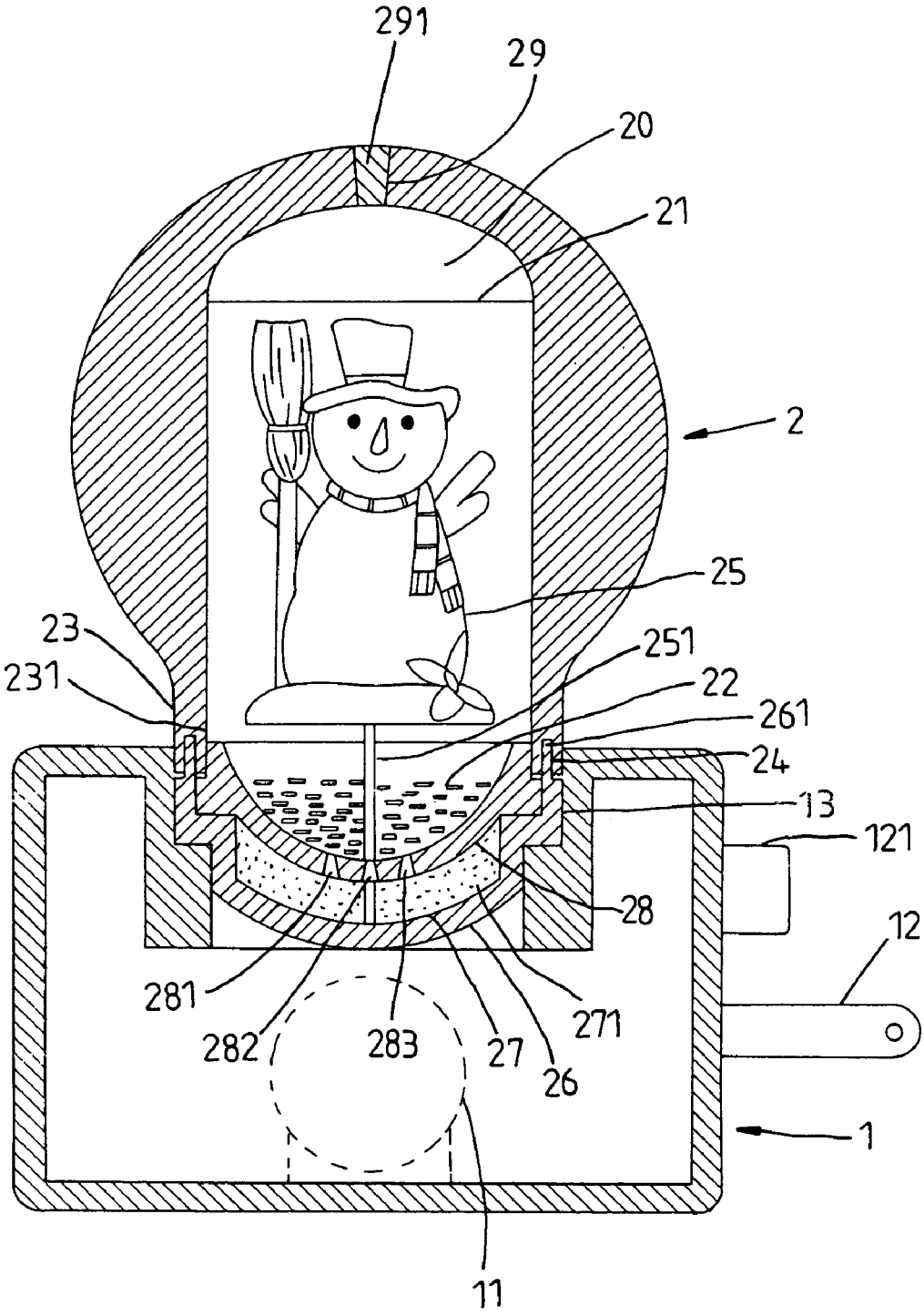
FIG. 4 is a sectional plain view of the thermal energy-actuated toy water globe according to the present invention.

Referring to FIGS. 2~4, a thermal energy-actuated toy water globe in accordance with the present invention is shown comprised of a globe body 2 and a lamp holder 1. The lamp holder 1 comprises a lamp bulb 11, an electric plug 12 connectable to an external alternating current outlet, and an on/off switch 121 adapted to on/off of the circuit connected between the lamp bulb 11 and the electric plug 12. The globe body 2 is a hollow shell holding a fluid 21 and glitters 22 in the fluid 21. The fluid 21 occupies a major part of the watertight inside space of the globe body 2, i.e., an air space 20 is left inside the globe body 2 above the fluid 21. The fluid 21 is an organic solvent of low boiling point, for example, dichloromethane ($Ch_2Cl_2$). The globe body 2 has a top filling hole 29 sealed with a stopper 291, and a bottom neck 23 defining a bottom opening 231. The bottom neck 23 has a mounting groove 24 in the bottom edge. Through the top filling hole 29, the fluid 21 is filled into the inside of the globe body 2. A bottom cover 26 is fastened to the bottom neck 23 to seal the bottom opening 231. The bottom cover 26 has a mounting flange 261 press-fitted into the mounting groove 24 of the bottom neck 23 of the glove body 2 and sealed thereto by, for example, a ultrasonic sealing process, and an inside annular positioning groove 263. A partition member 28 is mounted inside the bottom cover 26, having a mounting flange 280 press-fitted into the inside annular positioning groove 263 and a plurality of a small through holes 281, 283, 283 through the top and bottom sides. Further, a foam pad 27 is mounted inside the bottom cover 26 and held down by the partition member 280, having open spaces 271 therein. An ornament 25 is suspended inside the glove body 2, having a bottom mounting rod 251 inserted through the partition member 28 and the foam pad 27 and affixed to the bottom cover 26. Further, the lamp holder 1 has a top receiving hole 13 above the lamp bulb 11 adapted to receive the bottom neck 23 of the globe body 2.

Referring to FIG. 3 again, when switch on the on/off switch 121, the lamp bulb 11 is turned on to emit light. During operation of the lamp bulb 11, heat is produced by the lamp bulb 11 to heat the fluid 21 in the globe body 2 to the boiling status (the boiling point of dichloromethane is about 39° C.). When boiled, the fluid 21 produces acidic gas, thereby resulting in a convection current, and therefore air bubbles 211 are produced to move the glitters 22 in the boiling fluid 21.

According to the present invention, the globe body 2, the bottom cover 26, and the partition member 28 are respectively injection-molded from transparent plastics for the advantage of high safety.

A battery pack may be installed in the lamp holder 1 and electrically connected to the lamp bulb 11 through the on/off switch 121 to provide the lamp bulb 11 with the necessary working voltage. A power cord may be used instead of the aforesaid electric plug 12 for connecting the lamp holder 1 to an AC outlet.

As indicated above, the thermal energy-actuated water globe of the present invention has the following advantages:

1. The invention uses heat energy from the lamp bulb 11 to heat the low boiling point fluid 21, thereby producing a convection current to move the glitters 22 in the fluid 21.
2. Because the globe body 2, the bottom cover 26, and the partition member 28 are respectively injection-molded from transparent plastics, the water globe is safe in use.
3. The use of the foam pad 27 between the partition member 28 and the bottom cover 26 accelerates the speed of heating the fluid 21 to the boiling status.
4. The small through holes 281, 282, 283 of the foam pad 27 enables small bubbles 211 to be produced in the boiling fluid 21 smoothly.

While only one embodiment of the present invention has been shown and described, it will be understood that various modifications and changes could be made thereunto without departing from the spirit and scope of the invention disclosed.

What is claimed is:

1. A thermal energy-actuated toy water globe comprising:

a transparent plastic glove body, said glove body having a bottom neck sealed with a bottom cover and holding an organic solvent and glitters in said organic solvent;

a lamp holder supporting said globe body, said lamp holder comprising a top receiving hole adapted to accommodate the bottom neck and bottom cover of said globe body, a lamp bulb adapted to emit light and to heat said organic solvent to a boiling status when turned on to emit light, and a power switch adapted to switch on/off said lamp bulb; and an ornament mounted inside said globe body within said organic solvent and fixedly fastened to said bottom cover.

2. The thermal energy-actuated toy water globe as claimed in claim 1, further comprising a battery pack mounted inside said lamp holder and electrically connected to said lamp bulb through said power switch.

3. The thermal energy-actuated toy water globe as claimed in claim 1, wherein said lamp holder comprises a power cord connectable to an external AC outlet to obtain AC power supply to said lamp bulb through said power switch.

4. The thermal energy-actuated toy water globe as claimed in claim 1, wherein said globe body further comprises a partition member fastened to said bottom cover, said partition member having a plurality of through holes through top and bottom sides thereof, and a pad mounted inside said bottom cover and held down by said partition member, said pad having fine open spaced therein.

5. The thermal energy-actuated toy water globe as claimed in claim 1, wherein said bottom neck of said globe body has a bottom mounting groove; said bottom cover has a mounting flange press-fitted into said bottom mounting groove of said bottom neck and sealed by a ultrasonic sealing process.

6. The thermal energy-actuated toy water globe as claimed in claim 1, wherein said pad is a foam pad.

7. The thermal energy-actuated toy water globe as claimed in claim 1, wherein said globe body has a top filling hole sealed with a stopper.

8. The thermal energy-actuated toy water globe as claimed in claim 1, wherein said bottom cover comprises an inside annular mounting groove adapted to accommodate said partition member.

* * * * *